United States Patent [19]

Bauer et al.

[11] 4,408,449

[45] Oct. 11, 1983

[54] FRICTION FALSE TWISTING APPARATUS

[75] Inventors: Karl Bauer; Heinz Schippers; Peter Dammann, all of Remscheid, Fed. Rep. of Germany

[73] Assignee: Barmag Barmer Maschinenfabrik AG, Remscheid, Fed. Rep. of Germany

[21] Appl. No.: 272,936

[22] Filed: Jun. 12, 1981

Related U.S. Application Data

[63] Continuation-in-part of Ser. No. 168,734, Jul. 14, 1980, Pat. No. 4,339,915.

[30] Foreign Application Priority Data

Jun. 26, 1980 [DE] Fed. Rep. of Germany ..... 3023887

[51] Int. Cl.[3] ..... D02G 1/08; D01H 7/92

[52] U.S. Cl. ..... 57/340; 57/339; 57/348

[58] Field of Search ..... 57/334–340, 57/348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa | 57/340 X |
| 4,110,962 | 9/1978 | Schuster et al. | 57/339 |
| 4,145,871 | 3/1979 | Iwata et al. | 57/340 |
| 4,149,366 | 4/1979 | Bass et al. | 57/339 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1263829 | 2/1972 | United Kingdom . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus is disclosed which comprises a pair of circular discs which are mounted for rotation about generally parallel spaced apart axes, and such that portions of the surfaces are disposed in opposing face to face relation and define a twisting zone therebetween. In one embodiment, one of the discs is relatively thin and flexible, and such disc is resiliently biased toward the other disc only at the twisting zone. In other embodiments, both discs are relatively inflexible or rigid, and one disc is mounted to its supporting shaft by a gimbal-like interconnection and such disc is resiliently biased toward the other disc only at the twisting zone.

10 Claims, 8 Drawing Figures

FRICTION FALSE TWISTING APPARATUS

Figure 1:
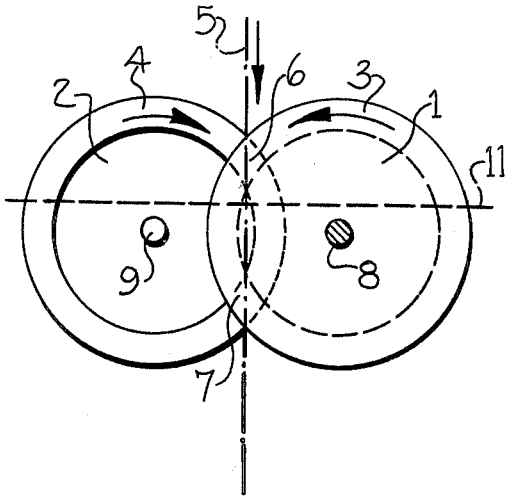

The present application is a continuation-in-part of copending application Ser. No. 168,734, filed July 14, 1980, now U.S. Pat. No. 4,339,915.

Yarn false twisting apparatus for the false twist texturing of synthetic filaments are known, and which consist of two circular discs which are rotated in opposite directions. Typically, the axes of rotation are inclined toward each other and the peripheral edges of the discs contact each other at the twisting zone. In one apparatus of this type, note German Patent Publication No. 1,192,779 and U.S. Pat. No. 4,145,871, the rotary discs are movable in the axial direction toward and away from each other and the discs are mechanically pressed against each other by spring pressure. The yarn is advanced along a path of travel which extends in a direction essentially perpendicular to the common plane of the two axes of rotation.

The above known friction false twist apparatus have not proved entirely successful in the industry however, since unavoidable inaccuracies in the manufacture, such as non-uniform bearing clearances, have led to slightly pulsating movements, of one or both discs. As a result, the vary is nipped with a pulsating or fluttering force, and is non-uniformly twisted and crimped.

It is an object of the present invention to avoid the above limitations of the known false twisting apparatus. These and other objects and advantages of the present invention are achieved in the illustrated embodiments by the provision of a false twisting apparatus of the described type, and which includes means for resiliently biasing one of the rotating discs toward the other disc or twist imparting member only at the twisting zone. In one embodiment, the disc is relatively thin and flexible, and its supporting shaft is mounted for pivotal movement about an axis extending in a direction transverse to the axis of the shaft. Spring biasing means is provided for urging the shaft about the transverse axis, in such a way that the disc is biased toward the other member only at the twisting zone. In another embodiment, the disc is relatively rigid, and it is mounted to its supporting shaft by a gimbal-like interconnection which permits the disc to freely incline with respect to the axis of the shaft. A pressure applying member is mounted adjacent the circular disc on the side opposite the friction surface and in alignment with the twisting zone, to bias the disc toward the other member at the twisting zone. In still another embodiment, the disc is relatively rigid and similarly mounted in a gimbal-like interconnection to its supporting shaft, and the shaft is pivotally mounted for movement about a tranverse axis. Means are also provided for resiliently urging the shaft for movement about such transverse axis.

An advantage of the present invention resides in the fact that even in the event the disc is somewhat out of true run, it does not perform any transitory movements, i.e., movements effecting the nipping force and thus a constant nipping force can be provided by the pressure applying means.

The pressure applying member which acts upon the back side of the disc may be in the form of a roll or plunger, which is connected to a resilient supply of force, such as a pneumatic cylinder-piston assembly, spring, magnet, or the like. Where the pressure applying member is used to pivot the shaft about a transverse axis, it may also be connected to any desired known supply of force, as described above. However, in certain instances, a nonresilient force may be acceptable as the pivoting mechanism, such as an adjustable screw spindle.

In the present case, it is also advantageous that the pressure applying means insures a proper frictional engagement, in that the nipping gap is automatically adjusted to the particular yarn size or diameter.

Figure 1A:
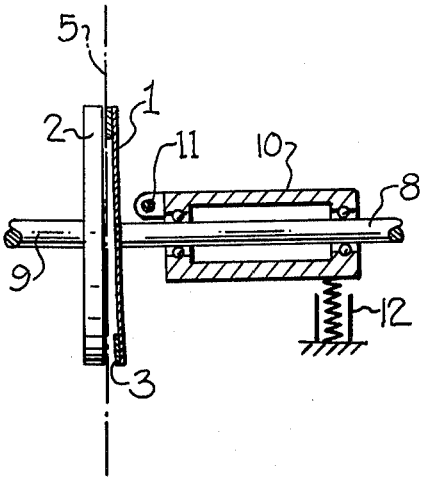
Figure 2:
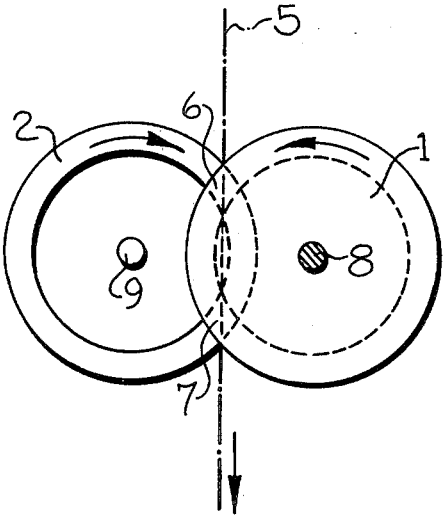
Figure 2A:
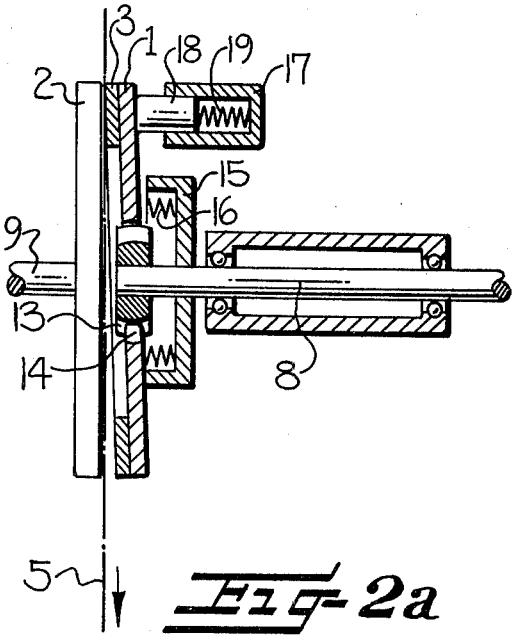
Figure 3:
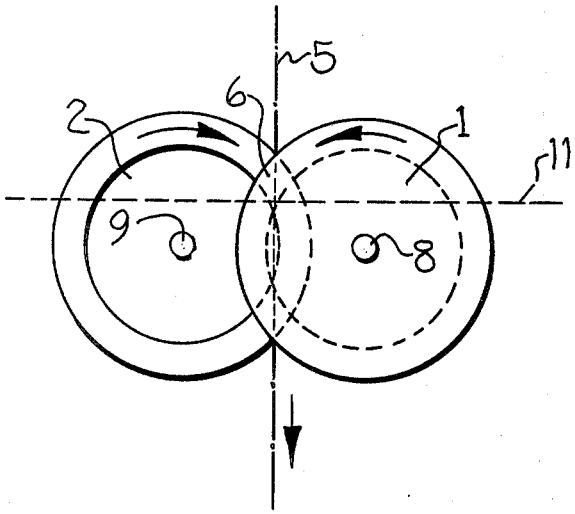
Figure 3A:
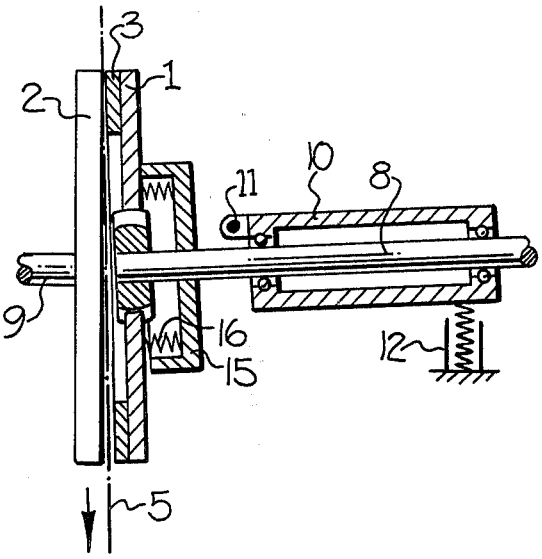
Figure 4:
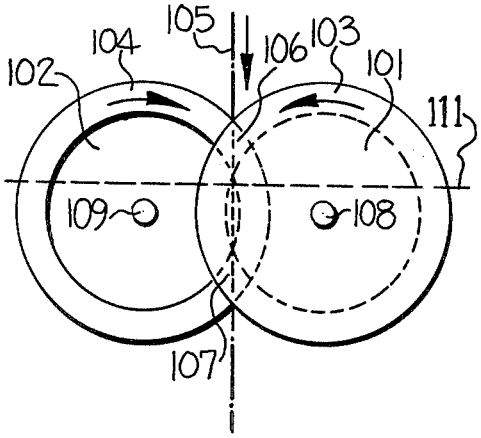
Figure 4A:
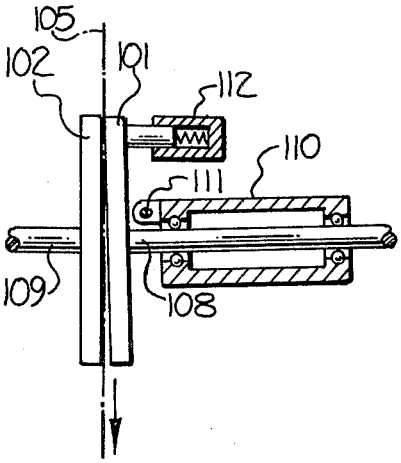

Some of the objects and advantages of the invention having been stated, others will appear as the description proceeds, when taken in connection with the accompanying drawings, in which:

FIG. 1 is a schematic front elevation view of a false twisting apparatus embodying the present invention;

FIG. 1*a* is a sectional side elevation view of the apparatus shown in FIG. 1;

FIG. 2 is a view similar to FIG. 1 and illustrating a second embodiment of the invention;

FIG. 2*a* is a sectional side elevation view of the apparatus shown in FIG. 2;

FIG. 3 is a view similar to FIG. 1 and illustrating still another embodiment of the present invention;

FIG. 3*a* is a sectional side elevation view of the apparatus shown in FIG. 3;

FIGS. 4 and 4*a* are views similar to FIGS. 1 and 1*a*, and illustrating a further embodiment of the invention.

Referring more specifically to the drawings, FIGS. 1 and 1*a* schematically illustrate a friction false twisting apparatus which comprises discs 1 and 2 which are driven in opposite directions. The disc 1 is relatively thin and flexible, while the disc 2 is relatively rigid. The discs are provided with frictional surface coatings 3 and 4 respectively, and a yarn 5 is adapted to be nipped in the nipping area or twisting zone 6, wherein the frictional coatings 3 and 4 overlap. Disc 1 is inclined and biased against the disc 2 so that the yarn travels freely without being nipped through the lower overlapping area 7 of the friction coatings 3 and 4.

The discs 1 and 2 are fixedly mounted on the shafts 8 and 9 respectively. The bearing of the shaft 8 consists of a bearing housing 10, which is mounted to pivot about an axis 11 which extends in a direction transverse to the axis of the shaft 8. The transverse axis 11 is also illustrated by the dashed line in FIG. 1. By the action of the pressure applying member 12, the bearing housing 10 is resiliently biased to pivot about the axis 11, and thus the disc 1 also inclines against the plane of rotation of the disc 2, with the disc 1 operatively contacting the disc 2 only at the twisting zone 6.

In the illustrated embodiment as shown in FIGS. 1 and 1*a*, the pressure applying member consists of a spring having an adjustable spring tension. It may however consist of a pneumatic cylinder-piston assembly, a magnet, or other supply of force.

The transverse axis 11 is so positioned that the nipping of the yarn 5 is facilitated in the area of overlap at the twisting zone 6 at the entry to the friction false twisting apparatus, and the gap in the overlying area 7 is increased. The fact that the disc 1 rests against the yarn in the area of zone 6 causes the disc 1, which is made of a resilient material, such as spring steel, and which is fixedly mounted on its shaft, to resiliently deform or deflect so that it inclines from the plane which is normal to its axis of rotation. Thus the yarn is resiliently nipped. The resilience of the disc 1 and of the pressure applying member 12 causes the gap between the discs 1 and 2 to automatically adjust to the thickness or diameter of the yarn.

In the embodiment of FIGS. 2 and 2*a*, both discs 1 and 2 are relatively rigid, i.e. non-flexible. The disc 2 is fixedly mounted to its supporting shaft, while the disc 1 is mounted to its supporting shaft 8 by a gimbal-like interconnection which permits the disc to freely incline with respect to the axis of the shaft 8. In the illustrated embodiment, the gimbal-like interconnection (Cardanic) includes a gear tooth system 13 and 14 on the shaft and disc respectively. A resiliently support is provided by a support plate 15 which is fixedly mounted to the shaft 8 adjacent the disc 1, and by the tension springs 16 which are interposed between the plate 15 and disc 1 at spaced points circumferentially about the axis of the shaft 8. Thus the disc is urged in a direction toward the disc 2 by the springs 16.

A pressure applying member 17 acts upon the back side of the disc 1. The member 17 includes a plunger 18 and spring 19, which resiliently presses the disc 1 against the yarn in the area 6 where the frictional coatings overlap. At the same time, the disc 1 inclines from the plane normal to its axis of rotation so that the gap for the thread line in the area of overlap 7 widens.

In the embodiment of FIGS. 3 and 3*a*, the disc 1 is mounted to its supporting shaft 8 in a manner corresponding to that described above with respect to FIGS. 2 and 2*a*. However, in the embodiment of FIGS. 3 and 3*a*, the disc 1 is biased toward the other disc 2 by means of a pressure applying member 12, which resiliently acts upon the bearing housing 10 of the shaft 8, and thus causes the shaft to pivot about the transverse axis 11. As a result, the yarn is resiliently nipped in the overlapping area 6, and the disc 1 is inclined from the plane normal to its axis of rotation.

In the embodiment of FIGS. 4 and 4*a*, both discs are relatively rigid. However, at least one disc may be flexible as described above. As illustrated, the discs 101 and 102 are mounted on the shafts 108 and 109 respectively, and they define a twisting zone 106 where the frictional coatings 103, 104 overlap. The discs are slightly separated at the lower overlapping zone 107, and such that the yarn 105 is nipped at the zone 106 and passes freely through the zone 107.

The bearing of the shaft 108 consists of a housing 110, which is mounted to pivot about the transverse axis 111. The housing 110 is resiliently biased to pivot about the axis 111 by the action of the pressure applying member 112, which is mounted adjacent the disc 101 so as to operatively contact the disc on the side opposite the friction surface and in alignment with the twisting zone 106. Thus the disc 101 inclines against the plane of rotation of the disc 102, with the disc 101 operatively contacting the disc 102 only at the twisting zone 106, and so that the gap in the zone 107 widens.

The illustrated constructions of the discs and mounting means therefor, with the use of a resilient pressure applying member, makes it possible to false twist high denier yarns at very high twists, and to thereby obtain a high degree of crimping of such yarns.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a pair of twist imparting members, with each member including a yarn engaging friction surface, and at least one of said members comprising a readily flexible circular disc mounted on a supporting shaft, means rotatably mounting said twist imparting members such that portions of the respective yarn engaging friction surfaces are disposed in opposing, face to face relationship and define a twisting zone therebetween, and with at least that portion of said flexible disc which includes said friction surface being resiliently deflected from its normal plane of rotation at said twisting zone by its engagement with the friction surface of the other member or a yarn passing therebetween, and drive means for operatively rotating each of said twist imparting members about their respective axes, whereby a yarn may be continuously advanced through said twisting zone while having twist imparted thereto by frictional contact between the yarn and the respective opposed friction surfaces.

2. The yarn false twisting apparatus as defined in claim 1 wherein said mounting means includes means mounting said shaft for pivotal movement about an axis extending in a direction transverse to the axis of said shaft, and means resiliently urging said shaft about said transverse axis.

3. A yarn false twisting apparatus comprising a pair of twist imparting members, with each member including a yarn engaging friction surface, and at least one of said members comprising a circular disc, means rotatably mounting said twist imparting members such that portions of the respective yarn engaging friction surfaces are disposed in opposing, face to face relationship and define a twisting zone therebetween, said mounting means for said disc comprising a rotatable shaft, and gimbal-like interconnection means mounting said disc to said shaft so as to permit said disc to freely incline with respect to the axis of said shaft, drive means for operatively rotating each of said twist imparting members about their respective axes, and means resiliently biasing said disc toward the other member only at said twisting zone, whereby a yarn may be continuously moved through said twisting zone while having twist imparted thereto by frictional contact between the yarn and the respective opposed friction surfaces.

4. A yarn false twisting apparatus comprising a pair of twist imparting members, with each member including a yarn engaging friction surface, and at least one of said members comprising a circular disc, means rotatably mounting said twist imparting members such that portions of the respective yarn engaging friction surfaces are disposed in opposing, face to face relationship and define a twisting zone therebetween, said mounting means for said disc comprising a rotatable shaft, and gimbal-like interconnection means mounting said disc to said shaft so as to permit said disc to freely incline with respect to the axis of said shaft, and such that at least that portion of said disc which includes said friction surface is resiliently deflected from its normal plane of rotation at said twisting zone by its engagement with the friction surface of the other member or a yarn passing therebetween, and drive means for operatively rotating each of said twist imparting members about their respective axes, whereby a yarn may be continuously moved through said twisting zone while having twist imparted thereto by frictional contact between the yarn and the respective opposed friction surfaces.

5. The yarn false twisting apparatus as defined in claim 3 or 4 wherein said at least one of said members comprises a relatively rigid circular disc.

6. A yarn false twisting apparatus comprising a pair of twist imparting member, with each member including a yarn engaging friction surface, and at least one of said members comprising a circular disc fixedly mounted on a supporting shaft, means rotatably mounting said twist imparting members such that portions of the respective yarn engaging friction surfaces are disposed in opposing, face to face relationship and define a twisting zone therebetween, drive means for operatively rotating each of said twist imparting members about their respective axes, and means resiliently biasing said disc toward the other member only at said twisting zone, said biasing means comprising means mounting said shaft for pivotal movement about an axis extending in a direction transverse to the axis of said shaft, and means resiliently urging said shaft about said transverse axis and including a pressure applying member mounted adjacent said disc so as to operatively contact said disc on the side opposite said friction surface in alignment with said twisting zone, whereby a yarn may be continuously moved through said twisting zone while having twist imparted thereto by frictional contact between the yarn and the respective opposed friction surfaces.

7. The yarn false twisting apparatus as defined in claim 3 wherein said interconnection means includes a support member fixedly mounted to said shaft adjacent said disc, and spring means interposed between said support member and said disc at spaced points circumferentially about the axis of said shaft for urging said disc in a direction toward said other twist imparting member.

8. The yarn false twisting apparatus as defined in either claim 3 or 7 wherein said biasing means comprises a pressure applying member mounted adjacent said circular disc so as to operatively contact said disc on the side opposite said friction surface in alignment with said twisting zone.

9. The yarn false twisting apparatus as defined in either claim 3 or 7 wherein said biasing means comprises means mounting said shaft for pivotal movement about an axis extending in a direction transverse to the axis of said shaft, and means resiliently urging said shaft about said transverse axis.

10. The yarn false twisting apparatus as defined in claim 6 wherein each of said twist imparting members comprises a relatively rigid circular disc.

* * * * *